US006864793B2

(12) United States Patent
Ono et al.

(10) Patent No.: US 6,864,793 B2
(45) Date of Patent: Mar. 8, 2005

(54) MAGNETIC MARKER AND MANUFACTURING METHOD THEREFOR

(75) Inventors: Yoshiki Ono, Yokohama (JP); Tatsuya Kurihara, Yokohama (JP); Shigemi Sato, Yokohama (JP); Sumikazu Oki, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 338 days.

(21) Appl. No.: 10/097,882

(22) Filed: Mar. 14, 2002

(65) Prior Publication Data

US 2002/0122956 A1 Sep. 5, 2002

Related U.S. Application Data

(63) Continuation of application No. PCT/JP01/06167, filed on Jul. 17, 2001.

(30) Foreign Application Priority Data

Jul. 17, 2000 (JP) ..... 2000-216089
Jul. 17, 2000 (JP) ..... 2000-216090

(51) Int. Cl.[7] ..... G08B 13/14

(52) U.S. Cl. ..... 340/572.6; 428/606; 428/611; 148/112; 148/301; 164/463; 29/527.5

(58) Field of Search ..... 340/572.6; 428/606, 428/611; 148/112, 301; 164/463; 29/527.5

(56) References Cited

U.S. PATENT DOCUMENTS 3,747,086 A 7/1973 Peterson ..... 340/572.2
4,257,830 A * 3/1981 Tsuya et al. ..... 148/112
4,495,691 A * 1/1985 Masumoto et al. ..... 29/527.5
4,496,395 A * 1/1985 Croat ..... 148/301
4,510,490 A * 4/1985 Anderson et al. ..... 340/572.1
4,523,626 A * 6/1985 Masumoto et al. ..... 164/463
4,617,983 A * 10/1986 Tsubata et al. ..... 164/463

(List continued on next page.)

FOREIGN PATENT DOCUMENTS

| | | |
|---|---|---|
| EP | 0 782 013 A2 | 7/1997 |
| GB | 1 369 903 | 10/1974 |
| JP | 61-153799 | 7/1986 |
| JP | 62-242319 | 10/1987 |
| JP | 41150447 A * | 6/1989 |
| JP | 3-243246 | 10/1991 |
| JP | 4-195384 | 7/1992 |
| JP | 4-220800 | 8/1992 |
| JP | 6-44471 | 2/1994 |
| JP | 8-235460 | 9/1996 |
| JP | 10-188151 | 7/1998 |

*Primary Examiner*—Benjamin C. Lee
(74) *Attorney, Agent, or Firm*—Scully, Scott, Murphy & Presser

(57) ABSTRACT

A magnetic marker comprises a magnetically switchable wire and a magnetic casing that covers the magnetically switchable wire. The magnetically switchable wire is formed of a magnetic material that undergoes occurrence of sharp magnetic inversion when an alternating field of intensity higher than its coercive force is applied to it. The magnetic casing is formed of a magnetically hard or semi-hard magnetic material and can apply a bias magnetic field to the magnetically switchable wire to prevent magnetic inversion of the magnetically switchable wire. Heat-treated portions and high-coercivity regions, which are not heat-treated, are formed alternately in the longitudinal direction on the magnetic casing. The heat-treated portions are given magnetic properties different from magnetic properties essential to the magnetic casing by heat treatment such as annealing.

24 Claims, 5 Drawing Sheets

U.S. PATENT DOCUMENTS 4,660,025 A * 4/1987 Humphrey ..... 340/572.2
4,686,516 A * 8/1987 Humphrey ..... 340/572.3
4,946,746 A * 8/1990 Ichiryu et al. ..... 428/606
4,980,670 A * 12/1990 Humphrey et al. ..... 340/551
5,554,974 A * 9/1996 Brady et al. ..... 340/572.6
5,565,849 A * 10/1996 Ho et al. ..... 340/572.6
5,605,768 A * 2/1997 Furukawa et al. ..... 428/611
5,870,021 A * 2/1999 Gadonniex ..... 340/551
5,926,095 A * 7/1999 Ho et al. ..... 340/572.6
6,011,475 A * 1/2000 Herzer ..... 340/572.6
6,018,296 A * 1/2000 Herzer ..... 340/572.5
6,023,226 A * 2/2000 Morin et al. ..... 340/572.1
6,057,766 A * 5/2000 O'Handley et al. ..... 340/572.6
6,137,412 A * 10/2000 Herzer ..... 340/572.6
6,259,368 B1 * 7/2001 Ruhrig ..... 340/572.6
6,313,746 B1 * 11/2001 Emmerich et al. ..... 340/572.2
6,359,563 B1 * 3/2002 Herzer ..... 340/572.6

* cited by examiner

MAGNETIC MARKER AND MANUFACTURING METHOD THEREFOR

CROSS-REFERENCE TO RELATED APPLICATIONS

This is a continuation application of PCT Application No. PCT/JP01/06167, filed Jul. 17, 2001, which wash not published under PCT Article 21(2) in English.

This application is based upon and claims the benefit of priority from the prior Japanese Patent Applications No. 2000-216089, filed Jul. 17, 2000; and No. 2000-216090, filed Jul. 17, 2000, the entire contents of both of which are incorporated herein by reference.

BACKGROUND OF THE INVENTION

1. Field of the Invention

The present invention relates to a magnetic marker for pulse generation used in an article monitoring system or the like and a manufacturing method therefor.

2. Description of the Related Art

If magnetic markers (also called tags) used in an anti-shoplifting burglarproof system for commodities, for example, are provided on the outer surface of the commodities, they may possibly be removed maliciously. It is to be desired, therefore, that the markers should be previously loaded (for source tagging) into the commodities or packaging containers at the product production stage.

A low-coercivity material described in Jpn. Pat. Appln. No. 62-242319 or Jpn. Pat. Appln. KOKAI Publication No. 4-220800 is known as a prior art related to magnetic markers. Also known are a high-permeability, low-coercivity material described in U.S. Pat. No. 4,660,025 and strips or wires of which the magnetization curves exhibit major Barkhausen discontinuity.

Magnetic markers that are formed of these conventional magnetic materials have the following matters to be studied on their length. Thus, in order to generate high-level pulse signals that can be securely detected at a detection gate, the ratio "length/(cross-sectional area or diameter corresponding to cross-sectional area)" of the marker and the cross-sectional area have lower limits.

In the case of U.S. Pat. No. 4,660,025, for example, the antimagnetic field coefficient never exceeds 0.000125. This implies that the ratio "length/diameter corresponding to cross-sectional area" of the marker that uses an elongate magnetic substance such as a strip or wire cannot be lower than about 200. In the case of U.S. Pat. No. 3,747,086, on the other hand, the ratio "length/square root of diameter corresponding to cross-sectional area" exceeds about 200. Even if the aforesaid dimensional conditions provided by those individual prior arts are met, however, accurate detection requires a strip or wire length of 50 mm or more in the case where the passage width of the detection gate is 90 cm or more, in particular.

Described in Jpn. Pat. Appln. KOKAI Publication No. 4-195384, on the other hand, is a configuration such that the ratio "length/(cross-sectional area or diameter corresponding to cross-sectional area)" of a strip or wire can be lowered. More specifically, a longitudinal end portion of the strip or wire is provided with a soft magnetic foil that has a coercive force smaller than a coercive force of the strip or wire. This is expected to reduce antimagnetic fields that are generated in the longitudinal direction in the case where a strip or wire alone is used.

The antimagnetic fields are magnetic fields that are simultaneously generated in a magnetic material so as to restrain an external magnetic field (i.e., to prevent magnetization of the material) in a direction opposite to the direction of the external magnetic field in a manner such that magnetic poles (north pole on one side and south pole on the other side) are formed individually at the opposite ends of the magnetic material when the magnetic field is externally applied in a specific direction and magnetized, if the magnetic material is finite in the direction of the external magnetic field.

The aforesaid marker described in Jpn. Pat. Appln. KOKAI Publication No. 4-195384 has a problem that it requires a lot of manufacturing processes and entails increased cost, since it includes a number of components. According to this prior art, moreover, miniaturization of the marker is restricted in view of workability in working process for cutting the magnetic material and a process for lapping the low-coercivity material and the soft magnetic foil on each other, so that the marker is inevitably relatively conspicuous in appearance. Further, there are restrictions on the portion of an article on which the marker is provided. In the case where the marker is pasted on a curved surface, moreover, the respective contact portions of the soft magnetic foil and the strip or wire may be disengaged, and the properties of the marker may be worsened by deformation. Thus, the marker of this type is not always suited for source tagging.

Thus, in consideration of the manufacturability, external appearance, and miniaturization (reduction in width, in particular) of the marker, its stickability to curved surfaces, etc., this prior art has the same problems with the aforesaid marker of Jpn. Pat. Appln. KOKAI Publication No. 4-220800. In order to give an inactivating function to this marker of Jpn. Pat. Appln. KOKAI Publication No. 4-195384, moreover, a hard magnetic material should be provided along the strip or wire, so that the component configuration of the marker is further complicated, inevitably.

Accordingly, there has been a demand for magnetic markers that enjoy high productivity and low cost and are suited for source tagging.

Further, the magnetic materials described in Jpn. Pat. Appln. No. 62-242319, Jpn. Pat. Appln. KOKAI Publication No. 4-220800, U.S. Pat. No. 4,660,025 and the strips or wires of which the magnetization curves exhibit major Barkhausen discontinuity have a problem that the antimagnetic fields sharply increase as the ratio "length/(cross-sectional area or diameter corresponding to cross-sectional area)" lowers. Since the influence of the antimagnetic fields constitutes an obstacle to the magnetization of the strip or wire, meaning that the magnetic material cannot fulfill its essential functions. Thus, the ratio "length/(cross-sectional area or diameter corresponding to cross-sectional area)" has its lower limit.

The smaller the magnetic poles (intensity of magnetization) formed individually at the opposite ends of the magnetic material or the longer the distance between the two magnetic poles, the smaller the antimagnetic fields become. In the cases of wires and strips where an alternating field is applied in the longitudinal direction of the magnetic material and a signal based on magnetic inversion in the same direction is detected by means of a coil, therefore, the influence of the antimagnetic fields can be lessened by making the wire or strip long and slender. Thus, the higher the "length/(cross-sectional area or diameter corresponding to cross-sectional area)" is, the smaller the influence of the antimagnetic fields can be made.

In order to reduced the antimagnetic fields by means of the strip or wire alone, in other words, it is necessary only that its length be shortened without changing the lower limit of the ratio "length/(cross-sectional area or diameter corresponding to cross-sectional area)". This implies that the cross-sectional area is also reduced. However, the level of a signal that can be detected by means of a coil in a detection gate is proportional to the product of the intensity of magnetization and cross-sectional area of the wire or strip and magnetic inversion speed. If the cross-sectional area is reduced in proportion to the length, therefore, a pulse signal cannot be discriminated from disturbance noise that is caught by the detection coil. Accordingly, the cross-sectional area also has a lower limit. On the other hand, the reduction of the cross-sectional area may possibly be compensated by increasing the intensity of magnetization of the material. However, this causes an increase of antimagnetic fields.

In the case of a magnetic marker that uses a conventional wire or strip, therefore, accurate discrimination from disturbance noise requires a magnetic marker length of at least 50 mm if the frontage (passage width) of the detection gate is 90 cm or more. Actually, however, there is a demand for small-sized wire-type markers with lengths of 40 mm or less that can be detected with high accuracy even if the passage width of the detection gate is 90 cm or more.

There is also a demand for markers that can be previously loaded (for source tagging) into commodities or packaging containers in the stage of their production so that an operator of a cash register or the like can inactivate the markers or cancel their pulse generating function without being conscious of the presence of the markers as he/she clears off the payment for the commodities. Since a marker is inactivated by placing a commodity having the marker therein on an inactivating apparatus or passing it over the inactivating apparatus, the markers are expected to be able to be inactivated without touching the inactivating apparatus.

Conventionally, there is a proposal to bring a marker having a low-coercivity material and a high-coercivity substantially into contact with the surface of an inactivating apparatus having a predetermined magnetic field pattern, thereby transferring the magnetic field pattern to the high-coercivity material, as is described in Jpn. Pat. Appln. No. 62-242319, for example. Once the high-coercivity material is polarized, in this case, the predetermined magnetic field pattern remains in it if it leaves the inactivating apparatus. Allowing the magnetization pattern to remain in this manner will be referred to as pattern polarization hereinafter.

A static bias magnetic field can be applied to the low-coercivity material of the magnetic marker by pattern polarization. This static bias magnetic field serves to prevent the low-coercivity material of the marker from undergoing magnetic inversion in an alternating field in the detection gate. Alternatively, the region of the low-coercivity material that undergoes magnetic inversion diminishes, so that a signal excited by the detection coil becomes extremely low. In consequence, the marker is inactivated. In this case, the magnetic field pattern of the inactivating apparatus must be transferred to the high-coercivity material, making it hard to inactivate the marker in a non-contact manner.

On the other hand, there is a proposal to expose a marker to a magnetic field that is formed by half-wave-rectifying a static magnetic field in one direction or alternating field, as is described in Jpn. Pat. Appln. KOKAI Publication No. 4-220800. In this case, a north or south pole can be left in the end portions of the high-coercivity material even after the marker is moved away from the magnetic field that is obtained by half-wave-rectifying the static magnetic field in one direction or alternating field. Accordingly, a desired static bias magnetic field can be applied without transferring the magnetic field pattern to the high-coercivity material. Thus, the marker can be inactivated in a non-contact manner.

The aforesaid technique described in Jpn. Pat. Appln. KOKAI Publication No. 4-220800 has a problem that the marker requires a lot of manufacturing processes and entails increased cost, since it includes a number of components. With use of the high-coercivity material described in this publication, moreover, miniaturization of the marker is restricted in view of workability in working process for cutting the material and a process for lapping on the low-coercivity material, so that the marker is inevitably relatively conspicuous in appearance. Further, there are restrictions on the portion of an article on which the marker is provided. In the case where the marker is pasted on a curved surface, moreover, the low-coercivity material may bend at the end portions of the high-coercivity material, thereby worsening in properties, owing to dislocation of the respective overlapping portions of the low-coercivity material and the high-coercivity material or difference in stiffness between the two materials. Thus, the marker of this type is not always suited for source tagging.

In order to solve these problems, the inventors hereof proposed a wire-type marker designed so that a magnetically switchable wire is covered by means of a magnetic casing for canceling, as is described in Jpn. Pat. Appln. KOKAI Publication No. 10-188151. Disclosed in connection with this prior art is an arrangement such that holes or notches are formed at given spaces in the magnetic casing for canceling, whereby a plurality of pairs of magnetic poles N and S can be polarized alternately. However, there is a demand for magnetic markers that enjoy higher productivity and lower cost and are more suited for source tagging.

Accordingly, a first object of this invention is to provide a small-sized magnetic marker with a simple construction that can be detected with high accuracy even in a gate having a wide passage. Further, a second object of this invention is to provide a magnetic marker that can be activated and inactivated in a non-contact manner.

BRIEF SUMMARY OF THE INVENTION

The inventors hereof undertook extensive research to obtain a high-productivity marker that has a construction simpler than that of a conventional magnetic marker. In order to enable the detection even of short magnetic markers, with high accuracy in a detection gate with a frontage of 90 cm or more, the inventors considered the following points.

(I) Let it be supposed that a certain antimagnetic field is acting opposite to an externally given magnetic field in the longitudinal direction of a magnetic marker. If magnetic anisotropic energy that can resist the antimagnetic field exists in the longitudinal direction of the magnetic marker, it can be believed that the magnetization characteristics that fulfill the essential functions of the magnetic marker never worsen. The magnetic anisotropic energy described herein is a criterion that indicates the liability to magnetization in a specific direction. Thus, it can be supposed that the magnetization characteristics never worsen even when the antimagnetic field becomes greater by enhancing the magnetic anisotropic energy of the magnetic marker.

(II) The aforesaid magnetic anisotropic energy can be effectively maximized by using a magnetic material that can concentratedly induce the direction for easy magnetization to one direction and giving the material uniaxial magnetic anisotropy such that the direction of magnetization cannot easily shift if the magnetic field acts in another direction.

(III) It can be believed that a magnetization curve of an ideal uniaxial magnetic anisotropic material exhibits a rectangular hysteresis loop and major Barkhausen discontinuity, as it is conventionally called, when magnetic inversion occurs. Coercive force that develops at this time is believed to represent a resisting force against magnetic fields (external magnetic field plus antimagnetic field) that are applied opposite to the direction in which the magnetic material is temporarily magnetized. Thus, a greater antimagnetic field can be resisted with use of a material exhibiting a hysteresis loop that is not an ideal rectangular hysteresis loop but maximally resembles it, exhibiting major Barkhausen discontinuity, and having as great a coercive force as possible.

(IV) The higher the power supplied to the detection gate, the greater the alternating field amplitude (external magnetic field) the gate applies to the magnetic marker can be. These days, however, it is to be desired that the alternating field amplitude (external magnetic field) should be lessened to meet the demand for lower power consumption. If the magnetic field amplitude at the lowest-value point in a gate having a frontage of 90 to 180 cm is 240 A/m or more, for example, this magnetic field cannot be used with ease in view of reduction in power consumption. Accordingly, the coercive force of the magnetic marker should be adjusted to the highest possible value below 240 A/m.

(V) The intensity of magnetization should be lowered in order to reduce antimagnetic fields. However, the intensity of magnetization and the cross-sectional area of the material have their respective appropriate ranges in which a detection signal in the detection gate can be enhanced.

In consideration of these circumstances, a thorough examination was made of a magnetically switchable wire to be used in a magnetic marker that, having a length of even 40 mm or less, for example, can be highly accurately detected in a gate having a frontage of 90 cm, without suffering deterioration in magnetization characteristics that is attributable to the antimagnetic fields. In consequence, the following materials were found.

The magnetically switchable wire has a diameter of 70 $\mu$m to 110 $\mu$m, is formed of any of magnetic materials including Fe-3 to 5% Si-1 to 3% Ni, Fe-3 to 6% Si-1 to 4% Mo, Fe-3 to 5% Si-1 to 3% Co. etc., and has a structure such that primary arms of a dendrite are oriented at an angle of 10° or less to the axial direction. If the respective concentrations of the components other than Fe exceed the aforesaid ranges in this competition, the intensity of magnetization in magnetic fields given in the detection gate lowers or the magnetic anisotropy declines. Otherwise, a crystalline phase that exhibits no major Barkhausen discontinuity is generated, meaning that satisfactory signals for the detection and the judgment in the gate having the frontage of 90 cm or more cannot be obtained with use of the aforesaid diameter ranges.

If the respective concentrations of the components other than Fe are below the aforesaid ranges, the intensity of magnetization increases, and the influence of the antimagnetic fields is enhanced, meaning that the magnetization characteristics worsen inevitably. Although the wire diameter was reduced to 70 $\mu$m or less to lessen the antimagnetic fields, therefore, no satisfactory signals were detected in the detection gate.

Accordingly, the magnetic marker of the present invention is characterized in that a magnetically switchable wire used therein has a diameter of 70 $\mu$m to 110 $\mu$m and a length of 40 mm or less, and is formed of at least one magnetic material selected from alloys including an alloy consisting mainly of Fe and containing 3 to 5% of Si and 1 to 3% of Ni, an alloy consisting mainly of Fe and containing 3 to 6% of Si and 1 to 4% of Mo, and an alloy consisting mainly of Fe and containing 3 to 5% of Si and 1 to 3% of Co. In this specification, the contents of chemical components are represented by % by mass unless otherwise specified.

According to this invention, even the small marker with a length of 40 mm or less can generate a high-level pulse signal that can be detected with high accuracy in a detection gate having a wide frontage of 90 cm or more, for example. The marker of this invention comprises few components, has a simple construction and small size, enjoys high productivity, and is suited for source tagging.

The magnetically switchable wire of this invention preferably has a structure such that primary arms of a dendrite are oriented at an angle of 10° or less to the axis of the wire. According to this invention, there may be provided a magnetic marker of which the magnetization curve has a hysteresis loop with good angularity and major Barkhausen discontinuity.

The following is a description of a magnetic marker manufacturing method of the present invention.

A rotating-liquid spinning method is described in Jpn. Pat. Appln. KOKOKU Publication No. 7-36942. Described in this publication is an iron-based filament in which primary arms of a dendrite are oriented at an angle of 20° or less to the axial direction. In the aforesaid composition of the magnetically switchable wire used in the magnetic marker of the present invention, the structure in which the primary arms are oriented at an angle of 10° or more has its axial magnetic anisotropy and coercive force lessened, so that its hysteresis loop has no angularity and exhibits no major Barkhausen discontinuity. Thus, it was found that the primary arms of the dendrite should be oriented at an angle of 10° or less to the axis. For the purpose of modification, such as acceleration of the growth of the dendrite, about 1% or less of minor additive elements may be added to the alloy composition of the present invention.

According to the rotating-liquid spinning method described in Jpn. Pat. Appln. KOKOKU Publication No. 7-36942, for example, structure portions can be obtained in which the primary arms of the dendrite are arranged at angles of 20° or less. In the case of this prior art, however, structure portions in which the primary arms are arranged at angles of 10° or less can ensure yield of about 10% or less of the overall length of the wire that is obtained for each cycle of spinning. Thus, the practical productivity is very low.

The inventors hereof examined the causes of this phenomenon and guessed them to be based on the following circumstances. According to the rotating-liquid spinning method, a cooling liquid causes a boiling phenomenon and suffers uneven boiling on the interface with a molten jet probably because of the influence of leakiness between the jet and the cooling liquid, and the jet cannot be cooled uniformly in the circumferential direction. Therefore, it is hard for the dendrite to grow by coagulation in the axial direction of the jet. As the jet enters a rotating liquid refrigerant layer and comes completely into contact with the cooling liquid, moreover, the jet may temporarily push away the liquid refrigerant layer, in some cases. Thus, voids may possibly be formed on the lower-stream side of the point where the jet enters the liquid layer, with respect to the direction of advance of the liquid refrigerant layer.

In consequence, the jet can be easily cooled with an asymmetric temperature distribution on its upper-and lower-stream sides, and it may possibly be difficult for the dendrite to grow by coagulation in the axial direction of the jet. Even in any method, other than the rotating-liquid spinning method, moreover, rapid cooling by means of a liquid refrigerant entails a very great cooling difference between the surface portion and the inside of the jet. Thus, the primary arms of the dendrite are liable to grow in the radial direction, not in the axial direction.

The manufacturing conditions were further examined in consideration of these circumstances. In consequence, application of an in-gas melt spinning method was contemplated such that the jet can be cooled relatively uniformly with respect to its circumferential direction, although the cooling speed is relatively low. It was found that a structure such that primary arms of a dendrite are arranged within an angle of 10° or less can be continuously manufactured in a spinning by applying this in-gas melt spinning method to a molten alloy jet having a diameter of 110 μm or less, in particular, and coagulating a molten alloy in a gas (or in the air).

Accordingly, a magnetic marker manufacturing method of the present invention comprises forming a magnetically switchable wire having a diameter of 70 μm to 110 μm by an in-gas melt spinning method such that the aforesaid alloy containing Fe-3 to 5% of Si-1 to 3% of Ni, Fe-3 to 6% Si-1 to 4% Mo, or Fe-3 to 5% Si-1 to 3% Co is melted, and the resulting molten alloy is cooled and coagulated in a cooling gas while being ejected from a nozzle, and cutting the wire to a length of 40 mm or less, thereby obtaining a magnetic marker adapted to undergo occurrence of magnetic inversion or major Barkhausen discontinuity or generation of pulses when an alternating field of intensity higher than the coercive force of the magnetically switchable wire is applied thereto.

According to this invention, a magnetically switchable wire for a magnetic marker that suits the object of the present invention can be obtained by the in-gas melt spinning method. The magnetically switchable wire that is obtained by the manufacturing method of the present invention can enjoy a structure that suits the object of the present invention throughout its area in the longitudinal direction. The in-gas melt spinning method is particularly fit for the improvement of productivity of the magnetically switchable wire and the reduction in cost. According to the in-gas melt spinning method, which depends on the conditions of the cooling gas, a structure that suits the object of the present invention was able to be also realized with use of a wire diameter of 110 μm or thereabouts. If necessary, the magnetically switchable wire of the present invention may be heat-treated.

Further, a manufacturing apparatus for a magnetically switchable wire for a magnetic marker of the present invention manufactures the magnetically switchable wire for the magnetic marker by using an alloy melting means for melting the aforesaid alloy containing Fe-3 to 5% Si-1 to 3% Ni, Fe-3 to 6% Si-1 to 4% Mo, or Fe-3 to 5% Si-1 to 3% Co, a spinning nozzle capable of forming a molten metal jet by downwardly ejecting the molten alloy in a manner such that the molten alloy falls, a gas flow cylinder located so as to surround a fall path for the molten metal jet, cooling gas introducing means for introducing a cooling gas for coagulating the molten metal jet into the gas flow cylinder, and a discharge portion through which the wire obtained as the molten metal jet is coagulated is discharged from the gas flow cylinder to the outside. According to this invention, the magnetically switchable wire for the magnetic marker that suits the object of the present invention can be obtained by the in-gas melt spinning method.

In some cases, an oxygen-containing gas should be used as the cooling gas. According to this invention, a protective coating of a thin oxide film is formed on the surface of the magnetically switchable wire, whereby a higher-quality magnetically switchable wire for the magnetic marker can be obtained.

Further, the cooling gas may contain a first gas component, formed of an inert gas to be introduced into the gas flow cylinder in a first position nearer to the spinning nozzle with respect to the falling direction of the molten metal jet in the gas flow cylinder, and a second gas component, formed of an oxidative gas to be introduced into the gas flow cylinder in a second position remoter from the spinning nozzle with respect to the falling direction of the molten metal jet. According to this invention, the high-quality magnetically switchable wire for the magnetic marker that suits the object of the present invention can be obtained with use of the inert gas component and the oxidative gas component that are contained by the cooling gas.

An example of the first gas component is argon or helium, and an example of the second gas component is oxygen or carbon dioxide. According to this invention, the high-quality magnetically switchable wire for the magnetic marker that suits the object of the present invention can be obtained with use of argon or helium, for use as an inert gas, and oxygen or carbon dioxide, for use as an oxidative gas.

The inventors hereof conducted extensive research to obtain high-productivity markers that have constructions simpler than that of the magnetic marker described in Jpn. Pat. Appln. KOKAI Publication No. 10-188151. In consequence, the inventors considered partially changing the crystalline construction, structure, internal distortion, etc. by heat-treating the part of the high-coercivity material that constitutes the magnetic casing. More specifically, the inventors contemplated differentiating the properties of the part of the magnetic casing formed of the high-coercivity material from the essential magnetic properties of the high-coercivity material, thereby enjoying the same function of a structure that is obtained by removing a part of the magnetic casing.

The properties different from those of the high-coercivity material include, for example, a property to demagnetize or weaken the magnetism of a part of the magnetic casing. Alternatively available are high-permeability, low-coercivity materials and materials having soft magnetic characteristics that are not as high as those of a strip or wire of which the magnetization curve exhibits major Barkhausen discontinuity. For example, a part of the magnetic casing may be changed into a soft magnetic material of which the magnetization curve exhibits no major Barkhausen discontinuity with relative permeability of 2,000 or less or coercive force of about 240 to 2,400 A/m.

Nonmagnetic and weak magnetic materials described herein include materials that exhibit paramagnetism, diamagnetism, and antiferromagnetism in the normal life environment at temperatures near room temperature. They also include materials that, whether ferromagnetic or ferrimagnetic, macroscopically have a relative permeability of about 100 or less and residual magnetization of 0.01 T or thereabouts. In short, the internal structures of these materials may be changed in any manner only if they are different from high-coercivity material portions in magnetic characteristics.

In the case where a part is changed into the soft magnetic material by heat treatment, according to the present invention, that part can be substantially magnetized if an externally applied magnetic field is a relatively small magnetic field. A magnetic field generated by this magnetization acts on a high-coercivity region that is perfectly integral as a solid, thereby fulfilling the same function as pattern polarization. If the magnetic marker is exposed in a non-contact manner to a one-direction static magnetic field or half-wave-rectified field that is generated by means of an apparatus for inactivating the magnetic marker, for example, the same magnetic poles that are obtained by pattern polarization can be generated by merely externally applying a relatively small magnetic field just strong enough to magnetize soft magnetic material portions of the marker. With use of this magnetic marker, therefore, the distance between the inactivating apparatus and the marker can be extended.

According to the present invention, a method for partial longitudinal heat treatment (hereinafter referred to also as pattern heating) to obtain the aforesaid heat-treated portion is not particularly restricted as long as it can change the properties of the high-coercivity material. For example, the method may be the conduction (DC, AC, or pulse) heating method, high-frequency (induction, dielectric, or microwave) heating method, laser heating method, burner heating, plasma-torch heating method, etc. The heating temperature should be adjusted to a value not lower than the straightening annealing temperature (400° C.), and preferably to a value not lower than the phase transformation temperature of the high-coercivity material.

The form of division between heated and unheated regions, that is, a heating pattern, is not restricted in particular. However, the heating pattern is effective if it includes two or more regions to be heated with respect to the overall length of the magnetic casing. Preferably, moreover, the dimensions of each heated region should be adjusted to the range from the outside diameter of the magnetic casing to 10 mm with respect to the longitudinal direction of the magnetic casing, to a quarter of the circumference of a circle or more with respect to the circumferential direction, and to a third of the overall thickness or more with respect to the thickness direction (or radial direction). The heating may be carried out before or after the magnetically switchable wire is enveloped in the magnetic casing.

A material with a coercive force of 2,400 A/m or more or Fe—Cr—Co—Ni—Mo-based alloy should be used as the high-coercivity material for the magnetic casing. Particularly preferred is a material obtained by aging Fe-20 to 35% Cr-5 to 15% Co that combines workability, high coercive force, and high maximum energy product.

Accordingly, a magnetic marker of the present invention that can be switched between active and inactive states comprises a magnetically switchable wire formed of a magnetic material and adapted to undergo occurrence of sharp magnetic inversion when an alternating field of intensity higher than the coercive force thereof is applied thereto, and a magnetic casing formed of a magnetically hard or semihard magnetic material, covering the magnetically switchable wire, and capable of generating a bias magnetic field to prevent magnetic inversion of the magnetically switchable wire, the magnetic casing having heat-treated portions partially differentiated in magnetic properties by heat treatment in the longitudinal direction thereof.

In an article monitoring system, according to this invention, even a small wire-type marker with a length of 40 mm or less can generate a high-level pulse signal that can be detected with high accuracy in a detection gate having a wide frontage of 90 cm or more, for example. The marker of this invention can be inactivated without touching the marker itself. The marker of this invention comprises few components, has a simple construction, enjoys high productivity, and is suited for source tagging. The magnetic casing of the magnetic marker of the present invention can satisfactorily fulfill the aforesaid effects, since high-coercivity region that have the essential properties of the magnetic casing and heat-treated portions by heat treatment with different magnetic properties are arranged continuously with one another.

The magnetically switchable wire used in the magnetic marker of the present invention may suitably be formed of any one of alloys Fe—Si, Fe—Si—Ni, Fe—Si—Mo, and Fe—Si—Co. According to this invention, the magnetic marker that suits the object of the present invention can be obtained with use of a Fe—Si, Fe—Si—Ni, Fe—Si—Mo, or Fe—Si—Co-based alloy.

Further, the magnetically switchable wire may be formed of an alloy consisting mainly of Fe and containing 3 to 5% of Si or an alloy consisting mainly of Fe and containing 3 to 5% of Si and 1 to 3% of Ni.

Furthermore, the magnetically switchable wire may be formed of an alloy consisting mainly of Fe and containing 3 to 6% of Si and 1 to 4% of Mo or an alloy consisting mainly of Fe and containing 3 to 5% of Si and 1 to 3% of Co.

Preferably, the magnetically switchable wire used in the magnetic marker of the present invention has a diameter of 70 $\mu$m to 110 $\mu$m and a length of 40 mm or less and is subject to sharp magnetic inversion.

Further, the magnetic casing used in the magnetic marker of the present invention is suitably formed of a magnetic material obtained by subjecting to aging heat treatment an alloy consisting mainly of Fe and containing 25 to 35% of Cr and 5 to 15% of Co. According to this invention, the magnetic marker with a length of 40 mm or less that suits the object of the present invention can be obtained with use of a magnetic casing that is obtained by aging the aforesaid alloy.

The manufacturing method for a magnetic marker of the present invention that can be switched between active and inactive states is characterized in that the aforesaid magnetically switchable wire is manufactured by the in-gas melt spinning method.

The magnetically switchable wire that is obtained by the manufacturing method of the present invention can enjoy a structure that suits the object of the present invention throughout its area. The in-gas spinning method (also referred to as in-gas melt spinning method) is particularly suitable for improvements in productivity of the magnetically switchable wire, and the reduction in cost. According to the in-gas spinning method, which depends on the conditions of the cooling gas, a structure that suits the object of the present invention was also able to be realized with use of a wire diameter of 110 $\mu$m or thereabouts. If necessary, the magnetically switchable wire of the present invention may be heat-treated.

In the manufacturing method of the present invention, the cooling gas may contain helium and oxygen. According to this invention, the magnetic marker that meets the object of the present invention can be obtained by the in-gas melt spinning method in which the cooling gas contains helium and oxygen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
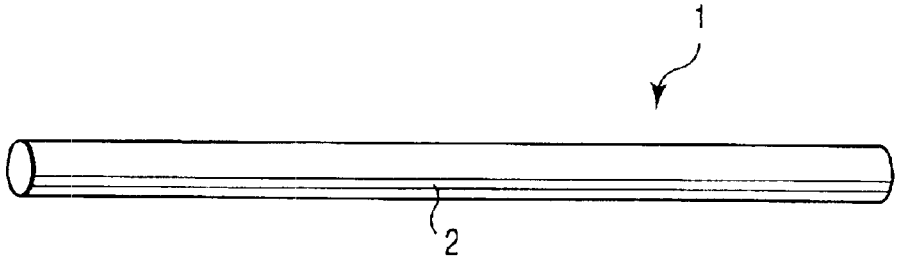
FIG. 1 is a perspective view of a magnetic marker showing one embodiment of the present invention.

As shown in FIG. 1, a magnetic marker 1 according to the present invention comprises a magnetically switchable wire 2. The magnetically switchable wire 2 is formed of a magnetic material represented by Examples 1, 2 and 3 mentioned later. The magnetic material described herein is an alloy that consists mainly of Fe and contains Si and Ni, Mo, or Co. The magnetically switchable wire 2 undergoes sharp magnetic inversion when it is subjected to an alternating field that surpasses its coercive force.

Figure 5:
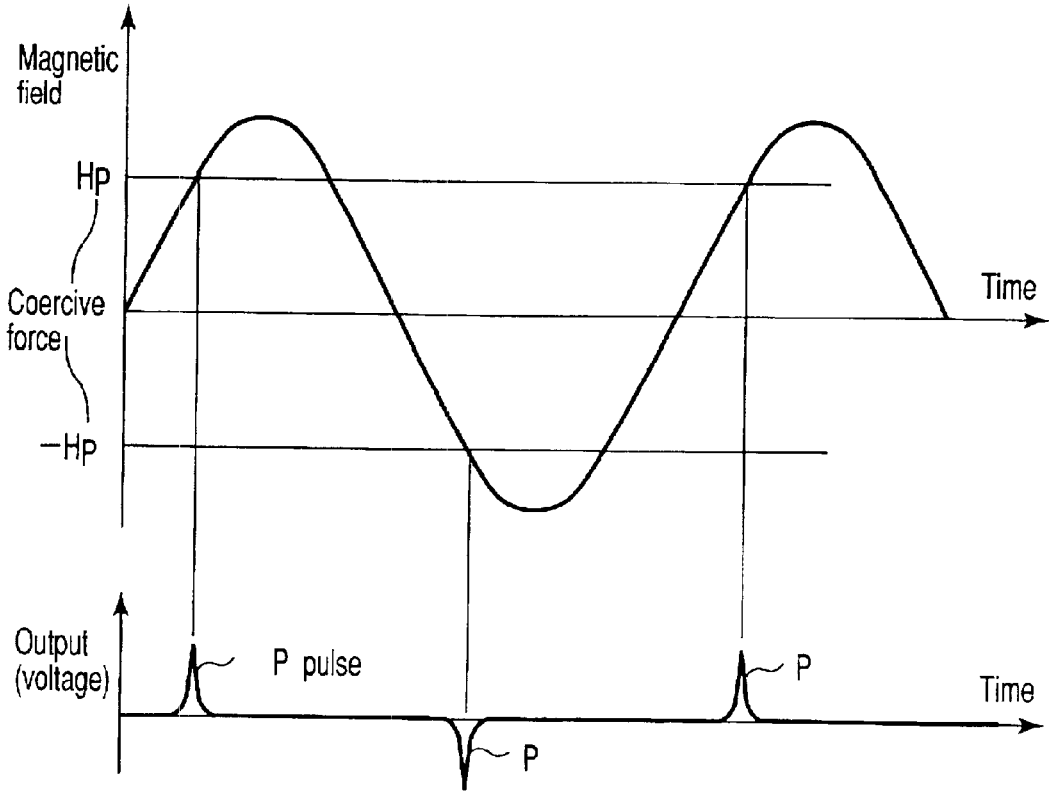
FIG. 5 is a diagram showing the relation between the exciting magnetic field and pulse output of the magnetic marker shown in FIG. 1.

When this magnetic inversion of the magnetically switchable wire 2 is detected by means of a solenoid coil, a pulsating output P such as the one shown in FIG. 5 is obtained. If the positive and negative coercive forces of the magnetically switchable wire 2 are Hp and −Hp, respectively, the magnetically switchable wire 2 undergoes magnetic inversion the moment the alternating field surpasses the coercive forces Hp and −Hp, whereupon a pulsating output voltage P corresponding to the magnetic inversion is detected. Since the width of each pulse is very narrow, the output voltage contains a lot of high-frequency components of several kHz or more. The aforesaid magnetic inversion hardly depends on the frequency of the applied alternating field, and an equal pulsating output P can be obtained even in the case where the frequency is low.

The magnetically switchable wire 2 is manufactured by using the in-gas melt spinning method. The in-gas melt spinning method is carried out by means of an in-gas melt spinning apparatus 10 schematically shown in FIGS. 2 and 3, for example. An example of the in-gas melt spinning apparatus 10 comprises a spinning pot 12 with a high-frequency heating coil 11, a spinning nozzle 13 with a nozzle hole 13*a* provided on the lower part of the spinning pot 12, a gas flow cylinder 14, a winding drum 15 located under the gas flow cylinder 14, etc. The winding drum 15 is a bottomed barrel formed of stainless steel or the like, and is rotated in the direction indicated by arrow R by means of a rotating mechanism (not shown). A molten metal jet J is ejected from the nozzle hole 13*a* of the spinning nozzle 13 in a manner such that it falls. The gas flow cylinder 14 is located so as to surround the outer periphery of the fall path of the molten metal jet J.

An alloy material 20 to be used as the material of the magnetically switchable wire 2 is stored in the spinning pot 12. The high-frequency heating coil 11 heats and melts the alloy material 20. The high-frequency heating coil 11 and the spinning pot 12 function as alloy melting means according to this invention. The spinning pot 12 is connected, by means of a seal member 22, with a gas inlet pipe 21 for supplying an inert gas such as argon for use as an injection pressure source for the melted alloy material 20.

The upper part of the gas flow cylinder 14 is connected with a helium gas supply pipe 23 for introducing helium gas as a cooling gas into the gas flow cylinder 14 a oxygen supply pipe 24 for introducing oxygen gas into the gas flow cylinder 14. These gas supply pipes 23 and 24 function as cooling gas introducing means according to this invention.

The jet of the molten alloy material 20 or the molten metal jet J is injected into the gas flow cylinder 14 through the nozzle hole 13*a*. The magnetically switchable wire 2 is formed as the molten metal jet J is cooled and coagulated in the gas flow cylinder 14. The oxygen supply pipe 24 is provided on the lower-stream side (lower side) of the gas flow cylinder 14 as compared with the helium gas supply pipe 23 with respect to the falling direction of the molten metal jet J. The magnetically switchable wire 2 coagulated in the gas flow cylinder 14 is continuously fed into the winding drum 15 through a lower-end discharge portion 14*a* of the gas flow cylinder 14.

Since a gas flow of the cooling gas can be concentrated uniformly and efficiently around the molten metal jet J with use of the gas flow cylinder 14 constructed in this manner, the magnetically switchable wire 2 which has a homogeneous structure that meets the object of the present invention can be obtained.

An oxygen-containing gas can be used as the cooling gas. With use of the oxygen-containing gas, a thin protective coating of an oxide is formed immediately on the surface of the molten metal jet J. This protective coating stabilizes the molten metal jet J and restrains the molten metal jet J from being further oxidized. Thus, it is hard for the oxide to be mixed into the magnetically switchable wire 2, so that a high-quality manufactured magnetically switchable wire 2 can be obtained.

In this embodiment, the alloy material 20 contains the Si component, so that the Si component quickly reacts with oxygen in the cooling gas, and the protective coating of an oxide film with a thickness of about 1 μm or less is formed. Accordingly, the progress of oxidation in the molten metal jet J can be restrained effectively, so that a high-quality magnetically switchable wire 2 can be obtained.

The oxygen-containing gas used as the cooling gas may be a gas that consists of 100% oxygen. In some cases, however, the cooling capacity of the cooling gas can be further improved with use of a gas mixture. More specifically, a gas mixture may be used that contains cooling accelerating gas components such as helium and ammonia that can contribute to the improvement of the cooling capacity and one or more oxidative gases that are selected from gases including oxygen and carbon dioxide.

Helium is particularly preferable in view of the cooling capacity. Carbon dioxide is a gas that combines oxidizability and cooling capacity, and can be also singly used as the oxygen-containing gas. Thus, the oxygen-containing gas described herein must only contain oxygen elements and is not always limited to a gas that contains oxygen molecules.

If only the oxygen-containing gas is used as the cooling gas, the nozzle hole 13*a* may be easily jammed by the oxidation of the molten metal jet J, in some cases. Since the magnetically switchable wire 2 with a very small diameter is manufactured in this case, it is advisable to minimize the thickness (e.g., about 0.1 to 1 μm) of the aforesaid oxide film that is formed on the surface of the wire 2 as long as its protecting function for molten alloy is maintained. To attain this purpose, it is necessary only that ambience near the nozzle hole 13*a* be kept so that its inert gas concentration is higher than on the lower-stream side. Preferably, the ambience near the nozzle hole 13*a* should be formed substantially of an inert gas alone.

More specifically, the cooling gas contains a first gas component (inert gas), which is introduced into the gas flow cylinder 14 by means of the supply pipe 23 in a first position on the upper-stream side with respect to the falling direction of the molten metal jet J, and a second gas component (oxidative gas), which is introduced into the gas flow cylinder 14 by means of the supply pipe 24 in a second position on the lower-stream side (side remote from the nozzle hole 13*a*) with respect to the falling direction of the molten metal jet J. The first gas component is one or more inert gases selected from inert gases such as argon, helium, etc. The second gas component is one or more oxidative gases selected from gases including oxygen and carbon dioxide.

Figure 2:
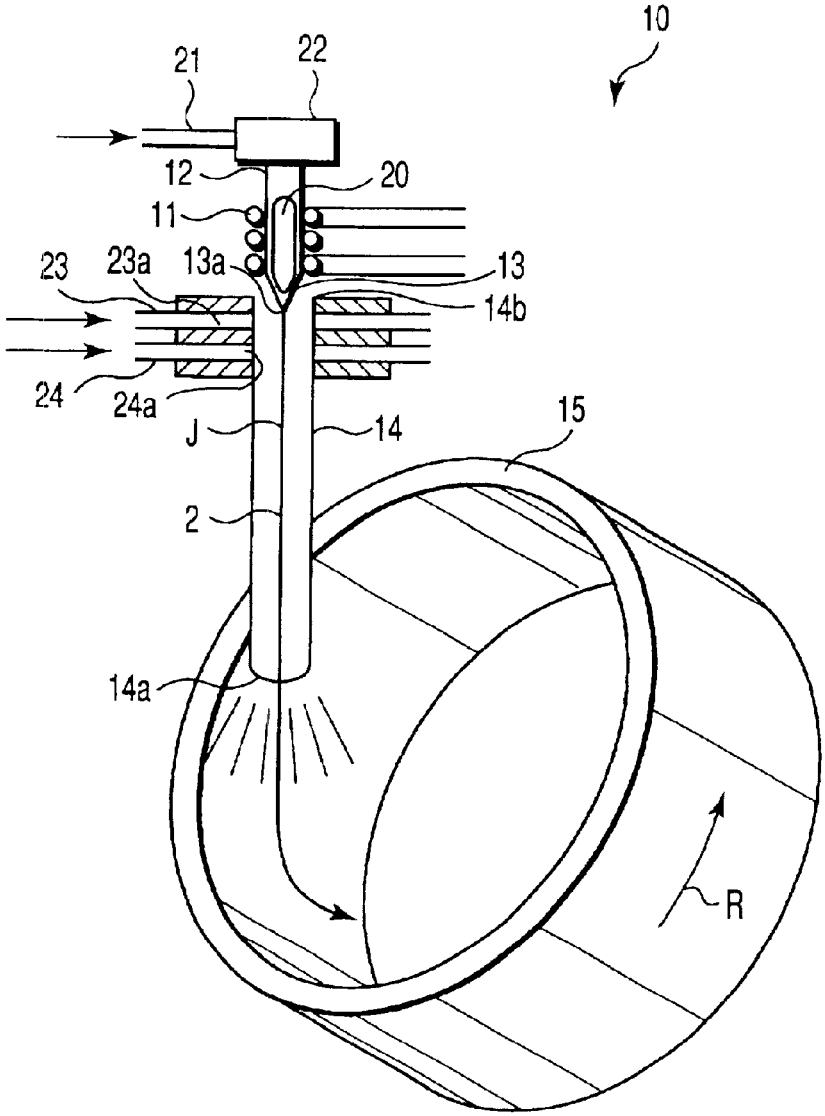
FIG. 2 is a perspective view showing an outline of an in-gas melt spinning apparatus for manufacturing a magnetically switchable wire used in the magnetic marker shown in FIG. 1.

In an upper-end opening 14*b* of the gas flow cylinder 14, in the example of FIG. 2, the nozzle hole 13*a* is located indenting the upper-end opening 14*b* for a short length (e.g., about 3 mm). At the upper part of the gas flow cylinder 14, an inert gas inlet 23*a* is formed in a position near the nozzle hole 13*a*. An oxygen inlet 24*a* is formed adjacent to the lower part of the inert gas inlet 23*a*.

In order to improve the cooling effect further without failing to restraining excessive oxidation of the molten metal jet J, cooling accelerating gas components such as ammonia and helium may be mixed with the aforesaid oxidative gas components and introduced into the gas flow cylinder 14 from the aforesaid second position. Alternatively, a gas inlet for introducing the cooling accelerating gases into the gas flow cylinder 14 may be added to the lower-stream side of the second position.

The magnetically switchable wire 2 coagulated in the cooling gas is wound up smoothly and efficiently by means of the inner peripheral surface of the rotating winding drum 15 in the form of a bottomed barrel.

Figure 3:
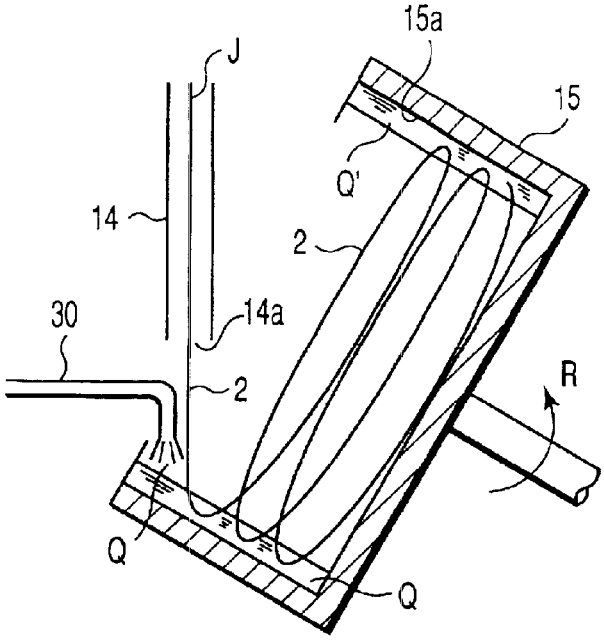
FIG. 3 is a sectional view of a part of the in-gas melt spinning apparatus shown in FIG. 2.

The magnetically switchable wire 2 coagulated in the cooling gas can be compulsorily cooled in a manner such that the magnetically switchable wire 2 is brought into contact with a liquid coolant Q, as shown in FIG. 3. The liquid coolant Q is water or cooling oil, for example. As the coagulated magnetically switchable wire 2 is compulsorily cooled by means of the liquid coolant Q, the magnetically switchable wire 2 can be prevented from undergoing undesired thermal deformation or the like. In this case, cooling can be carried out more smoothly and rapidly if the liquid coolant Q is introduced into the winding drum 15 through a coolant inlet pipe 30 so that the coagulated magnetically switchable wire 2 is cooled compulsorily.

The liquid coolant Q introduced into the winding drum 15 through the coolant inlet pipe 30 is made to form a coolant layer Q' on an inner peripheral wall surface 15*a* of the winding drum 15 by centrifugal force that is produced as the winding drum 15 rotates. The coagulated magnetically switchable wire 2 can be continuously compulsorily cooled by means of the coolant layer Q'.

The coagulation of the magnetically switchable wire 2 is substantially completed by the time when it reaches the winding drum 15 after having passed through the gas flow cylinder 14. The coolant layer Q' formed on the inner peripheral wall surface 15*a* of the drum 15 serves to lower the temperature of the coagulated magnetically switchable wire 2. Thus, the coolant layer Q' makes no substantial contribution toward the coagulation, construction, etc. of the molten metal jet J.

The nozzle hole 13*a* is a circular one that has a diameter 5% to 10% larger than that of the magnetically switchable wire 2 to be manufactured. However, an elliptic or oval nozzle hole may be used except for the case where a magnetically switchable wire as thin as a foil is manufactured. Let it be supposed that the inside diameter of the gas flow cylinder 14 ranges from 10 to 80 mm (e.g., about 30 mm), and the length of the gas flow cylinder 14 ranges from 200 to 1,000 mm, for example. Further, helium for use as the first gas component of the cooling gas and oxygen for use as the second gas component are circulated at the rates of about 0.5 to 20 l/min and 0.5 to 10 l/min, respectively. Furthermore, the molten metal jetting pressure at the distal end of the nozzle hole 13*a* is adjusted to about $5\times10^5$ to $25\times10^5$ Pa. By doing this, the magnetically switchable wire 2 having the structure that meets the object of the present invention can be obtained.

EXAMPLE 1

Figure 4:
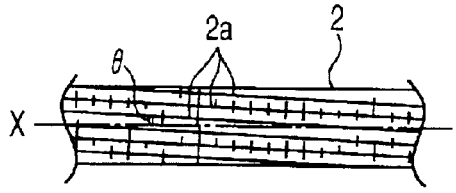
FIG. 4 is a side view typically showing a dendrite of the magnetically switchable wire manufactured by means of the spinning apparatus shown in FIG. 2.

A magnetically switchable wire 2 consisting of Fe-4% Si-2% Ni and having a diameter of 90 μm was manufactured by means of the in-gas melt spinning apparatus 10 described above. In this case, helium for use as the cooling gas and oxygen for use as the oxidative gas were introduced into the gas flow cylinder 14 through the gas supply pipes 23 and 24, respectively. As is schematically shown in FIG. 4, the obtained magnetically switchable wire 2 had a structure such that primary arms 2*a* of a dendrite were oriented at an angle θ of 4° or less to an axis X of the magnetically switchable wire 2. The intensity of magnetization and the coercive force of the magnetically switchable wire 2 were 1.1 T and 48 A/m, respectively, when an external magnetic field of 240 A/m was present. This magnetically switchable wire 2 was cut to length of 37 mm. A magnetization curve of a magnetic marker 1 formed of the magnetically switchable wire 2 exhibited a hysteresis loop with good angularity and major Barkhausen discontinuity. The magnetic marker 1 was able to be satisfactorily detected in a gate with a frontage of 140 cm, supplied electric power of 100 W, and alternating field frequency of 500 Hz.

EXAMPLE 2

A magnetically switchable wire 2 having a diameter of 105 μm and consisting of Fe-5% Si-2% Mo was obtained by using the in-gas melt spinning method. An apparatus for carrying out the in-gas melt spinning method, which was arranged substantially in the same manner as the apparatus 10 shown in FIG. 2, was provided with an inert gas supply pipe for supplying helium gas, in the down stream side of the oxygen supply pipe 24 that was situated subsequently to the helium supply pipe 23 located right under the spinning nozzle 13.

As is schematically shown in FIG. 4, the obtained magnetically switchable wire 2 had a structure such that primary arms 2*a* of a dendrite were oriented at an angle θ of 6° or less to the axis X of the magnetically switchable wire 2. This wire 2 was heat-treated at 900° C. The intensity of magnetization and the coercive force of the heat-treated magnetically switchable wire 2 were 1.2 T and 175 A/m, respectively, when an external magnetic field of 240 A/m was present. This magnetically switchable wire 2 was cut to a length of 25 mm. A magnetization curve of a magnetic marker 1 formed of the magnetically switchable wire 2 exhibited a hysteresis loop with good angularity and major Barkhausen discontinuity. The magnetic marker 1 was able to be satisfactorily detected in a gate with a frontage of 90 cm, supplied electric power of 100W, and alternating field frequency of 500 Hz.

EXAMPLE 3

A magnetically switchable wire 2 having a diameter of 84 μm and consisting of Fe-5.5% Si-1.5% Mo was obtained by using the in-gas melt spinning method. In the in-gas melt spinning method used in this case, helium and oxygen as cooling gases were introduced into the gas flow cylinder 14 through the gas supply pipes 23 and 24, respectively, by means of the in-gas melt spinning apparatus 10 shown in FIG. 2.

As is schematically shown in FIG. 4, the obtained magnetically switchable wire 2 had a structure such that primary arms 2*a* of a dendrite were oriented at an angle θ of 4° or less to the axis X of the magnetically switchable wire 2. The intensity of magnetization and the coercive force of the magnetically switchable wire 2 were 1.2 T and 45 A/m, respectively, when an external magnetic field of 240 A/m was present. This magnetically switchable wire 2 was cut to a length of 40 mm. A magnetization curve of a magnetic marker 1 formed of the magnetically switchable wire 2 exhibited a hysteresis loop with good angularity and major Barkhausen discontinuity. The magnetic marker 1 obtained in this manner was able to be satisfactorily detected in a gate with a frontage of 120 cm, supplied electric power of 100 W, and alternating field frequency of 500 Hz.

COMPARATIVE EXAMPLE 1

An Fe—Co—Si—B-based amorphous wire with a diameter of 120 μm was manufactured by the rotating-liquid spinning method. The intensity of magnetization and the coercive force of this wire were about 0.9 T and 8 A/m or less, respectively, when an external magnetic field of 240 A/m was present. The wire had low axial magnetic anisotropy and exhibited no Barkhausen discontinuity when it was cut to a length of 40 mm. The wire, 70 μm in wire diameter and 40 mm in length, was not be able to be easily discriminated from noise in a gate with a frontage of 90 cm, supplied electric power of 100 W, and alternating field frequency of 500 Hz.

COMPARATIVE EXAMPLE 2

A wire containing Fe-6.5% Si by mass with a diameter of 90 μm was manufactured by the in-gas melt spinning method. The intensity of magnetization and the coercive force of this wire were 1.4 T and 32 A/m, respectively, when an external magnetic field of 240 A/m was present. The wire lacked in axial magnetic anisotropy and exhibited no Barkhausen discontinuity when it was cut to a length of 40 mm. Although the wire, 50 μm in diameter and 40 mm in length, exhibited major Barkhausen discontinuity, it was not be able to be easily discriminated from noise in a gate with a frontage of 90 cm, supplied electric power of 100 W, and alternating field frequency of 500 Hz.

COMPARATIVE EXAMPLE 3

A wire of a magnetic material, Fe-6% Si-1% Mo, was manufactured by the rotating-liquid spinning method. A large part of this wire had a structure such that primary arms of a dendrite were aligned at an angle of 20° to the axis of the wire. Without regard to the wire diameter, however, the wire exhibited no Barkhausen discontinuity.

The following is a description of a magnetic marker according to another embodiment of the present invention that can be switched between active and inactive states.

Figure 6:
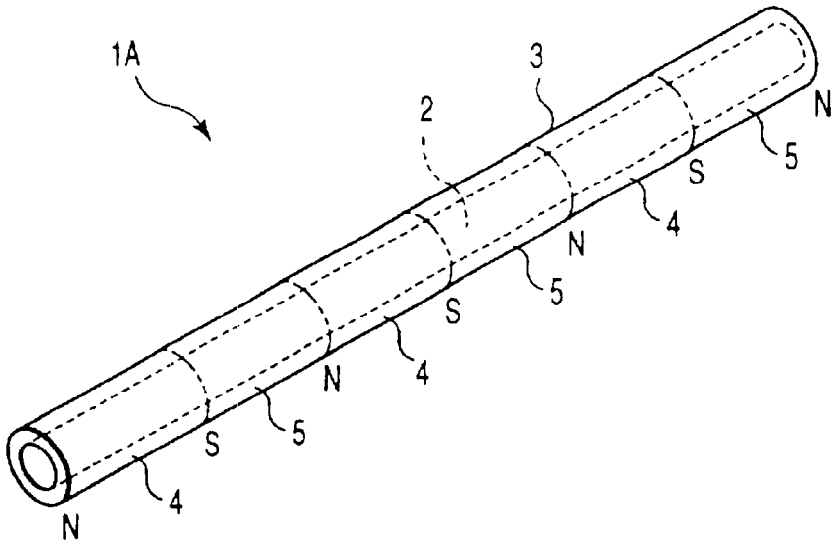
FIG. 6 is a perspective view of a magnetic marker according to another embodiment of the present invention, capable of being switched between active and inactive states.

A magnetic marker 1A shown in FIG. 6 comprises a magnetically switchable wire 2 and a cylindrical magnetic casing 3 for canceling that covers the outer periphery of the magnetically switchable wire 2. The magnetically switchable wire 2, which is formed of the same magnetic material of the wire 2 of the foregoing embodiment, undergoes sharp magnetic inversion when it is subjected to an alternating field that surpasses its coercive force. The magnetic casing 3 is formed of a magnetic material that is magnetically hard or semihard, and has a function to apply a bias magnetic field to the magnetically switchable wire 2 in order to prevent magnetic inversion of the magnetically switchable wire 2. Partial heat treatment is carried out in the longitudinal direction of the magnetic casing 3, whereby heat-treated portions 4, which have magnetic properties different from properties (high coercivity) essential to the magnetic casing 3, and high-coercivity regions 5 that are not heat-treated are formed alternately.

Figure 7:
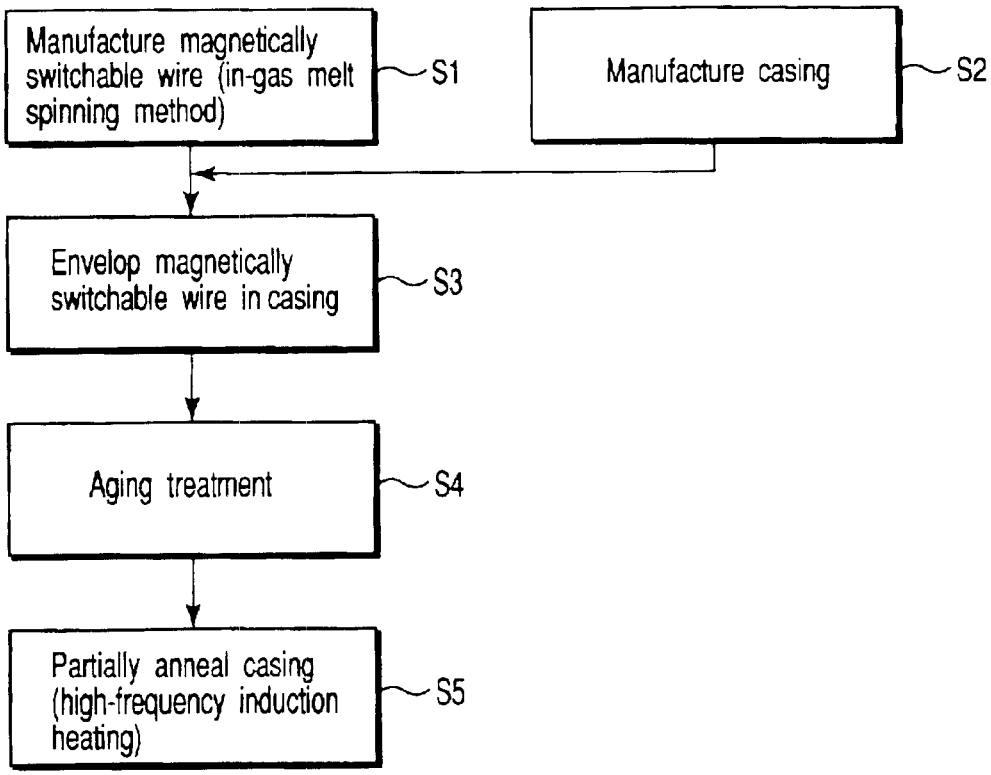
FIG. 7 is a flowchart illustrating a first example of a method for manufacturing the magnetic marker shown in FIG. 6.

The aforementioned marker 1A is manufactured in manufacturing processes outlined in FIG. 7.

In a wire manufacturing process of S1, a magnetically switchable wire 2 having a diameter of 90 μm and consisting of Fe-4% Si-2% Ni was obtained by using the in-gas melt spinning method. The in-gas melt spinning method is carried out by means of the in-gas melt spinning apparatus 10 that is schematically shown in FIG. 2, for example. The construction and function of the in-gas melt spinning apparatus 10 have been described in connection with the foregoing embodiment.

As is schematically shown in FIG. 4, the magnetically switchable wire 2 obtained in the wire manufacturing process S1 using the in-gas melt spinning apparatus 10 had a structure such that the primary arms 2*a* of the dendrite were oriented at the angle θ of 4° or less to the axis X of the magnetically switchable wire 2. The intensity of magnetization and the coercive force of the magnetically switchable wire 2 were 1.1 T and 48 A/m, respectively, when the external magnetic field of 240 A/m was present. The magnetization curve of this magnetically switchable wire 2, cut to a length of 37 mm, exhibited a hysteresis loop with good angularity and major Barkhausen discontinuity.

In a casing manufacturing process S2, on the other hand, a magnetic casing 3 having a thickness of 60 $\mu$m and formed of Fe-30% Cr-10% Co was obtained. In a cladding process S3, the outer periphery of the magnetically switchable wire 2 was enveloped in the magnetic casing 3. In an aging treatment process S4, thereafter, aging treatment was carried out.

In an annealing process S5, the magnetic casing 3 was partially annealed at 800° C. in its longitudinal direction (axial direction of the marker 1A) by high-frequency induction heating, whereupon the heat-treated portions 4 were formed. The length of each heat-treated portion 4 was, for example, 5 mm in the axial direction of the wire 2, and each heat-treated portion 4 was annealed throughout its whole circumference.

After the aging treatment process S4 and the annealing process S5 were carried out, the magnetic properties of the magnetically switchable wire 2 (Fe-4% Si-2% Ni) do not changed. The magnetic marker 1A obtained in this manner was able to be satisfactorily detected in a gate with a frontage of 140 cm, supplied electric power of 100 W, and alternating field frequency of 500 Hz. The magnetic marker 1A was able to be inactivated in a position right over and at a distance of 80 mm from an inactivating apparatus that generates a half-wave-rectified field amplitude of 160 kA/m and 50 Hz.

Figure 10:
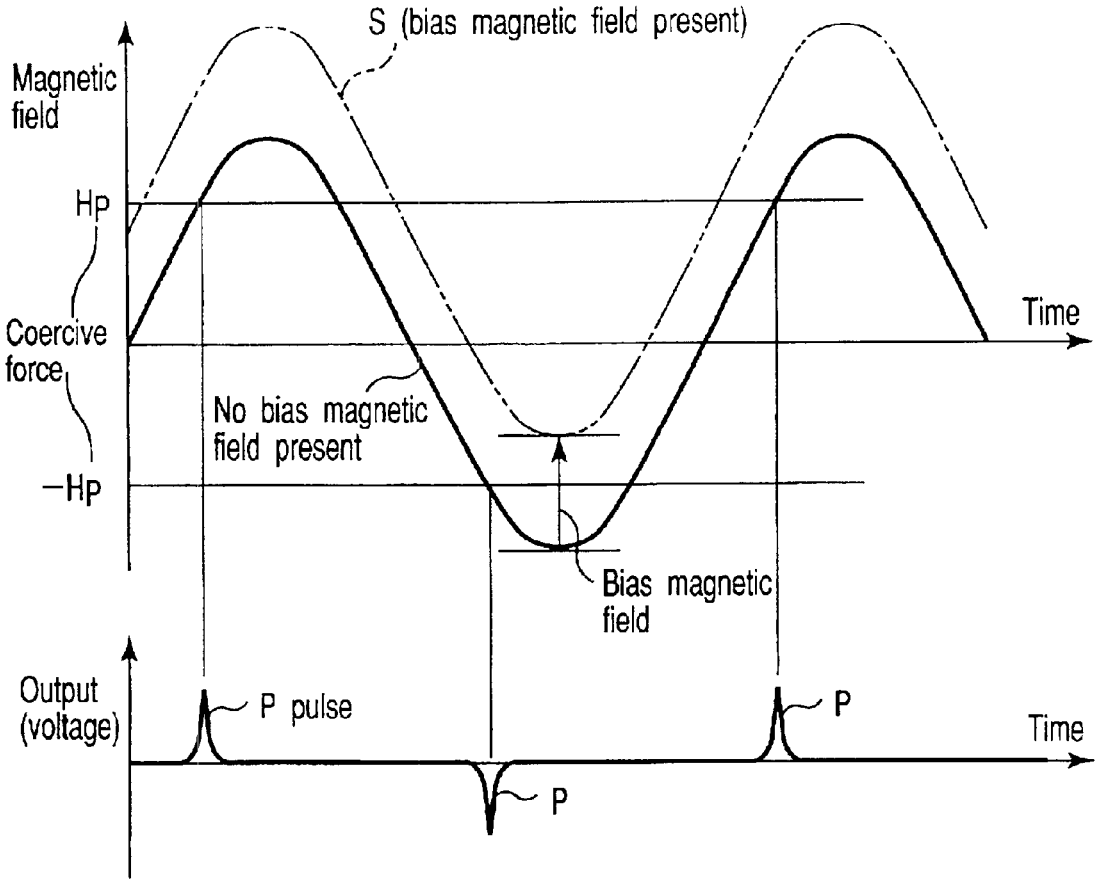
FIG. 10 is a diagram showing the relation between the exciting magnetic field and pulse output of the magnetic marker shown in FIG. 6.

When the magnetic inversion of the magnetically switchable wire 2 was detected by means of, for example, a solenoid coil in the aforesaid detection gate, a pulsating output P such as the one shown in FIG. 10 was obtained. If the positive and negative coercive forces of the magnetically switchable wire 2 are Hp and −Hp, respectively, the magnetically switchable wire 2 undergoes magnetic inversion the moment the alternating field surpasses the coercive forces Hp and −Hp, whereupon a pulsating output voltage P corresponding to the magnetic inversion is detected. Since the width of each pulse is very narrow, the output voltage contains a lot of high-frequency components of several kHz or more. The aforesaid magnetic inversion hardly depends on the frequency of the applied alternating field, and an equal pulsating output P can be obtained even in the case where the frequency is low.

If the magnetic casing 3 is polarized by means of the inactivating apparatus, a bias magnetic field can be applied to the magnetically switchable wire 2. If the bias magnetic field is applied, as indicated by the two-dot chain line S in FIG. 10, the alternating field that acts on the magnetically switchable wire 2 shifts above the coercive force (−Hp). Even if the alternating field is applied, therefore, no magnetic inversion occurs, meaning that no pulsating output P is generated. Thus, the magnetically switchable wire 2 loses its function and becomes inactive. The function of the magnetically switchable wire 2 can be restored (activated) by demagnetizing the magnetic casing 3 by means of the demagnetizing means.

Figure 8:
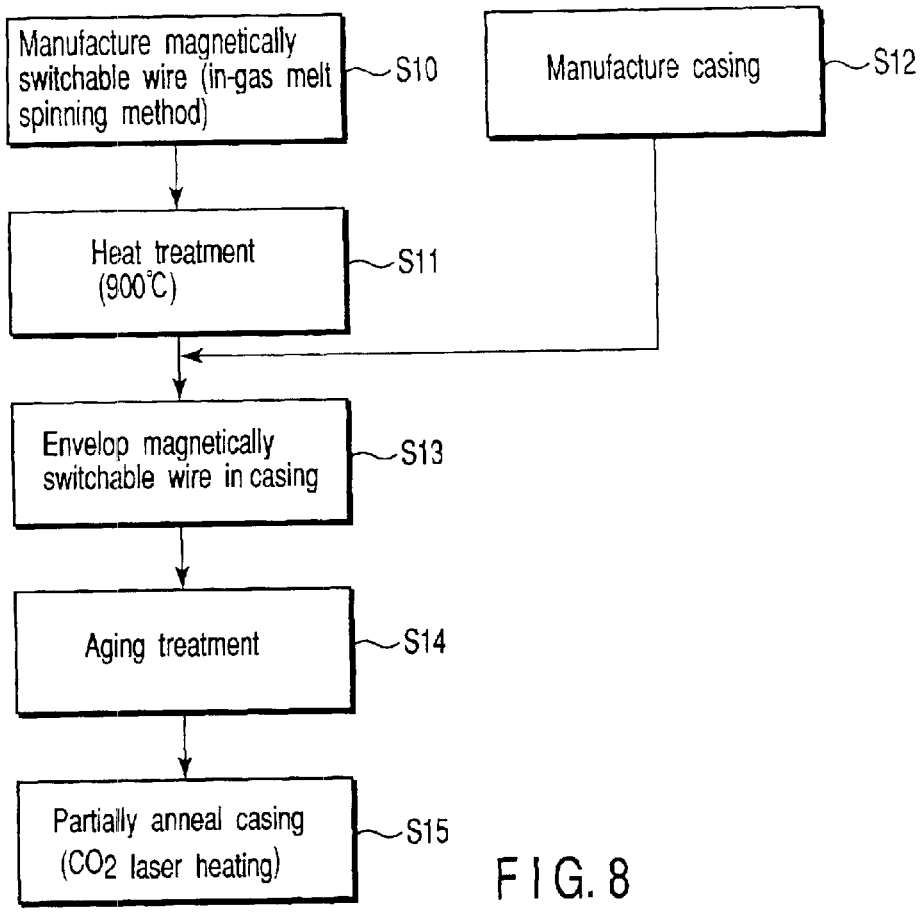
FIG. 8 is a flowchart illustrating a second example of the method for manufacturing the magnetic marker shown in FIG. 6.

The magnetic marker 1A can be also manufactured in manufacturing processes shown in FIG. 8. In a wire manufacturing process S10, among the manufacturing processes shown in FIG. 8, a magnetically switchable wire 2 having a diameter of 105 $\mu$m and consisting of Fe-5% Si-2% Mo was obtained by using the in-gas melt spinning method. An apparatus for carrying out the in-gas melt spinning method, which was arranged substantially in the same manner as the apparatus 10 shown in FIG. 2, was provided with an insert gas supply pipe for supplying helium gas, in the down stream side of the oxygen supply pipe 24 that was situated subsequently to the helium supply pipe 23 located right under the spinning nozzle 13.

As is schematically shown in FIG. 4, the obtained magnetically switchable wire 2 had a structure such that primary arms 2*a* of a dendrite were oriented at an angle θ of 6° or less to the axis X of the magnetically switchable wire 2. This wire 2 was heat-treated at 900° C. in a heat treatment process S11. The intensity of magnetization and the coercive force of the heat-treated magnetically switchable wire 2 were 1.2 T and 175 A/m, respectively, when an external magnetic field of 240 A/m was present. The magnetization curve of this magnetically switchable wire 2, cut to a length of 25 mm, exhibited a hysteresis loop with good angularity and major Barkhausen discontinuity.

In a casing manufacturing process S12, on the other hand, a magnetic casing 3 having a thickness of 48 $\mu$m and formed of Fe-13% Cr-9% Co-8% Ni-4% Mo was manufactured. In a cladding process S13, the outer periphery of the magnetically switchable wire 2 was enveloped in the magnetic casing 3. In an aging treatment process S14, thereafter, aging treatment was carried out.

In an annealing process S15, the magnetic casing 3 (Fe-13% Cr-9% Co-8% Ni-4% Mo) was partially annealed at 1,200° C. in its axial direction by $CO_2$ laser heating, whereupon the heat-treated portions 4 were formed. Each of these heat-treated portions 4 had a length of 3 mm in the longitudinal direction (axial direction) of the magnetic marker 1A, and each of high-coercivity regions 5 that were not annealed was 7 mm long. A quarter of the outer periphery (side face) of each heat-treated portion 4 was annealed.

After the aging treatment process S14 and the annealing process S15 were carried out, the magnetic properties of the magnetically switchable wire 2 (Fe-5% Si-2% Mo) do not substantially changed. The magnetic marker 1A obtained in this manner was able to be satisfactorily detected in a gate with a frontage of 90 cm, supplied electric power of 100 W, and alternating field frequency of 500 Hz. Further, the magnetic marker 1A was able to be inactivated in a position right over and at a distance of 80 mm from an inactivating apparatus that generates a half-wave-rectified field amplitude of 160 kA/m and 50 Hz.

Figure 9:
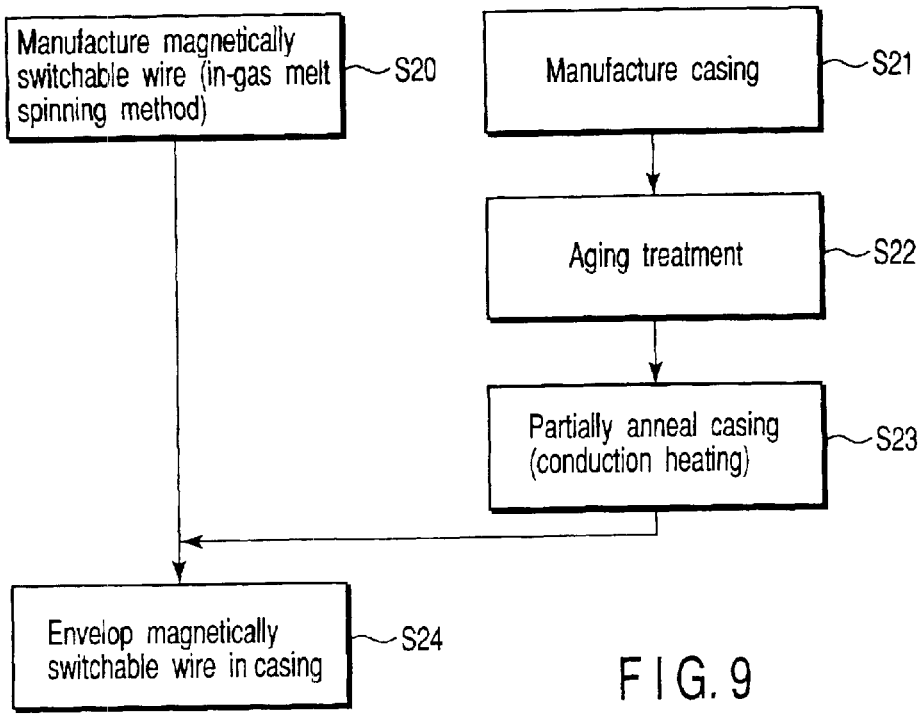
FIG. 9 is a flowchart illustrating a third example of the method for manufacturing the magnetic marker shown in FIG. 6.

The magnetic marker 1A can be also manufactured in manufacturing processes shown in FIG. 9. In a wire manufacturing process S20, among the manufacturing processes shown in FIG. 9, a magnetically switchable wire 2 having a diameter of 80 $\mu$m and consisting of Fe-4% Si was obtained by using the in-gas melt spinning method. The in-gas melt spinning method used in this case was carried out by means of an apparatus constructed substantially in the same manner as the in-gas melt spinning apparatus 10 shown in FIG. 2, although a gas supply pipe for supplying $CO_2$ gas was provided in the down stream side of the helium supply pipe 23.

As is schematically shown in FIG. 4, the obtained magnetically switchable wire 2 had a structure such that the primary arms 2*a* of the dendrite were oriented at the angle θ of 4° or less to the axis X of the magnetically switchable wire 2. The intensity of magnetization and the coercive force of the magnetically switchable wire 2 were 1.3 T and 45 A/m, respectively, when the external magnetic field of 240 A/m was present. The magnetization curve of this magnetically switchable wire 2, cut to a length of 40 mm, exhibited a hysteresis loop with good angularity and major Barkhausen discontinuity.

In a casing manufacturing process S21, a platelike magnetic casing 3 having a thickness of 80 $\mu$m, width of 600 $\mu$m, and formed of Fe-27% Cr-10% Co was manufactured. In an aging treatment process S22, the magnetic casing 3 was subjected to aging treatment. In an annealing process S23, after the aging treatment, the magnetic casing 3 was partially annealed at 900° C. by conduction heating, whereupon the heat-treated portions 4 were formed. Each of the heat-treated portions 4 had a length of 5 mm in the longitudinal direction of the magnetic casing 3, and each of high-coercivity regions 5 that were not annealed was 10 mm long. The whole region of each heat-treated portion 4 was annealed with respect to the width and thickness directions.

In a cladding process S24, the outer periphery of the magnetically switchable wire 2 (Fe-4% Si) was enveloped in the magnetic casing 3 (Fe-27% Cr-10% Co). The magnetic marker 1A obtained in this manner was able to be satisfactorily detected in a gate with a frontage of 120 cm, supplied electric power of 100W, and alternating field frequency of 500 Hz. Further, the magnetic marker 1A was able to be inactivated in a position right over and at a distance of 80 mm from an inactivating apparatus that generates a half-wave-rectified field amplitude of 160 kA/m and 50 Hz.

Figure 11:
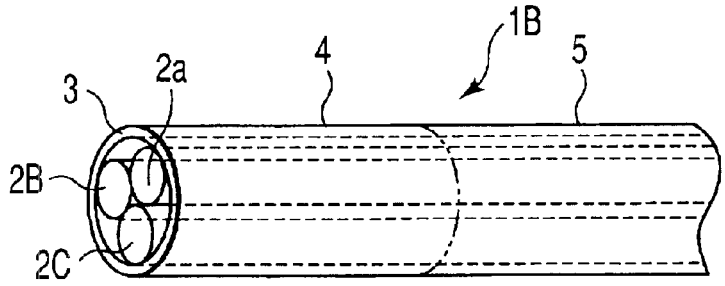
FIG. 11 is a perspective view of a part of a magnetic marker showing still another embodiment of the present invention.

FIG. 11 shows a magnetic marker 1B of still another embodiment of the present invention. This magnetic marker 1B comprises a plurality of magnetically switchable wires 2*a*, 2*b* and 2*c* and a magnetic casing 3 that covers these magnetically switchable wires 2*a*, 2*b* and 2*c*. These magnetically switchable wires 2*a*, 2*b* and 2*c*, which are formed of the same magnetic material of the aforementioned magnetically switchable wire 2, are manufactured by using the aforementioned in-gas melt spinning apparatus 10. In the case of this magnetic marker 1B, the magnetically switchable wires 2*a*, 2*b* and 2*c* having different coercive forces are used, so that more varied magnetic pulses can be generated when an alternating field is applied. The magnetically switchable wires 2*a*, 2*b* and 2*c* may be two or four or more in number.

The present invention is applicable to warehousing and shipment control of commodities, commodities control in the field of distribution, etc., including monitoring systems for preventing commodities from being stolen from stores, etc. Furthermore, the invention is applicable to fields that require control of various articles.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A magnetic marker comprising a magnetically switchable wire formed of a magnetic material and adapted to undergo a sharp magnetic inversion, or major Barkhausen discontinuity or generation of pulses when an alternating field of an intensity higher than the coercive force thereof is applied thereto, said magnetically switchable wire having a diameter of 70 $\mu$m to 110 $\mu$m and a length of 40 mm or less and being formed of at least one magnetic material having a dendrite structure and selected from alloys including an alloy consisting mainly of Fe and containing 3 to 5% of Si and 1 to 3% of Ni, an alloy consisting mainly of Fe and containing 3 to 6% of Si and 1 to 4% of Mo, and an alloy consisting mainly of Fe and containing 3 to 5% of Si and 1 to 3% of Co;

wherein said magnetically switchable wire has primary arms of dendrite which are oriented at an angle of 10° or less to the axis of said wire.

2. A manufacturing method for a magnetic marker, comprising:

forming a magnetically switchable wire having a diameter of 70 $\mu$m to 110 $\mu$m by an in-gas melt spinning method such that at least one magnetic material having a dendrite structure and, selected from alloys including an alloy consisting mainly of Fe and containing 3 to 5% of Si and 1 to 3% of Ni, an alloy consisting mainly of Fe and containing 3 to 6% of Si and 1 to 4% of Mo, and an alloy consisting mainly of Fe and containing 3 to 5% of Si and 1 to 3% of Co, is melted, and the resulting molten alloy is cooled and coagulated in a cooling gas while being ejected from a nozzle; wherein said magnetically switchable wire has primary arms of dendrite which are oriented at an angle of 10° or less to the axis of said wire; and cutting said wire to a length of 40 mm or less, thereby obtaining a magnetic marker adapted to undergo occurrence of magnetic inversion or major Barkhausen discontinuity or generation of pulses when an alternating field of intensity higher than the coercive force of said wire is applied thereto.

3. A manufacturing method for a magnetic marker, which manufactures a magnetically switchable wire for the magnetic marker by using:

alloy melting mechanism for melting at least one magnetic material having a dendrite structure and selected from alloys including an alloys consisting mainly of Fe and containing 3 to 5% of Si and 1 to 3% of Ni, an alloy consisting mainly of Fe and containing 3 to 6% of Si and 1 to 4% of Mo, and alloy consisting mainly of Fe and containing 3 to 5% of Si and 1 to 3% of Co; wherein said magnetically switchable wire has primary arms of dendrite which are oriented at an angle of 10° or less to the axis of said wire;

a spinning nozzle capable of forming a molten metal jet by downwardly ejecting said molten alloy in a manner such that the molten alloy falls;

a gas flow cylinder located so as to surround a fall path for said molten metal jet;

cooling gas introducing mechanism for introducing a cooling gas for coagulating said molten metal jet into said gas flow cylinder; and a discharge portion through which the wire obtained as said molten metal jet is coagulated is discharged from said gas flow cylinder to the outside.

4. A manufacturing method for a magnetic marker according to claim 3, wherein said cooling gas is an oxygen-containing gas.

5. A manufacturing method for a magnetic marker according to claim 3, wherein said cooling gas contains a first gas component, formed of an inert gas to be introduced into said gas flow cylinder in a first position nearer to said spinning nozzle with respect to the falling direction of said molten metal jet in said gas flow cylinder, and a second gas component, formed of a oxidative gas to be introduced into said gas flow cylinder in a second position remoter from said spinning nozzle with respect to the falling direction of said molten metal jet.

6. A manufacturing method for a magnetic marker according to claim 5, wherein said first gas component is argon or helium, and said second gas component is oxygen or carbon dioxide.

7. A magnetic marker comprising:

a magnetically switchable wire formed of a magnetic material and adapted to undergo occurrence of sharp magnetic inversion when an alternating field of intensity higher than the coercive force thereof is applied thereto; and a magnetic casing formed of a magnetically hard or semihard magnetic material, covering magnetically switchable wire, and capable of generating a bias magnetic field to prevent magnetic inversion of said magnetically switchable wire, said magnetic casing having heat-treated portions partially differentiated in magnetic properties by heat treatment in the longitudinal direction thereof.

8. A magnetic marker according to claim 7, wherein said magnetically switchable wire is formed of any selected one of alloys including Fe—Si, Fe—Si—Ni, Fe—Si—Mo, and Fe—Si—Co.

9. A magnetic marker according to claim 8, wherein said magnetically switchable wire has a diameter of 70 $\mu$m to 110 $\mu$m and a length of 40 mm or less and is formed of a magnetic material subject to said sharp magnetic inversion.

10. A magnetic marker according to claim 8, wherein said magnetic casing is formed of a magnetic material obtained by subjecting to aging heat treatment an alloy consisting mainly of Fe and containing 25 to 35% of Cr and 5 to 15% of Co.

11. A magnetic marker according to claim 8, wherein said magnetically switchable wire has a structure such that primary arms of a dendrite are oriented at an angle of 10° or less to the axis of said magnetically switchable wire.

12. A magnetic marker according to claim 8, which comprises a plurality of magnetically switchable wires and said magnetic casing enveloping the magnetically switchable wires.

13. A magnetic marker according to claim 12, wherein the respective coercive forces of said plurality of magnetically switchable wires are different from one another.

14. A magnetic marker according to claim 7, wherein said magnetically switchable wire is formed of an alloy consisting mainly of Fe and containing 3 to 5% of Si.

15. A magnetic marker according to claim 7, wherein said magnetically switchable wire is formed of an alloy consisting mainly of Fe and containing 3 to 5% of Si and 1 to 3% of Ni.

16. A magnetic marker according to claim 7, wherein said magnetically switchable wire is formed of an alloy consisting mainly of Fe and containing 3 to 6% of Si and 1 to 4% to Mo.

17. A magnetic marker according to claim 8, wherein said magnetically switchable wire is formed of an alloy consisting mainly of Fe and containing 3 to 5% of Si and 1 to 3% of Co.

18. A magnetic marker according to claim 7, wherein said magnetically switchable wire has a diameter of 70 $\mu$m to 110 $\mu$m and a length of 40 mm or less and is formed of a magnetic material subject to said sharp magnetic inversion.

19. A magnetic marker according to claim 7, wherein said magnetic casing is formed of a magnetic material obtained by subjecting to aging heat treatment an alloy consisting mainly of Fe and containing 25 to 35% of Cr and 5 to 15% of Co.

20. A magnetic marker according to claim 7, wherein said magnetically switchable wire has a structure such that primary arms of a dendrite are oriented at an angle of 10° or less to the axis of said magnetically switchable wire.

21. A magnetic marker according to claim 7, which comprises a plurality of magnetically switchable wires and said magnetic casing enveloping the magnetically switchable wires.

22. A magnetic marker according to claim 21, wherein the respective coercive forces of said plurality of magnetically switchable wires are different from one another.

23. A manufacturing method for a magnetic marker, which comprises a magnetically switchable wire formed of a magnetic material and adapted to undergo a sharp magnetic inversion when an alternating field of intensity higher than the coercive force thereof is applied thereto, and a magnetic casing formed of a magnetically hard or semihard magnetic material, covering said magnetically switchable wire, and capable of generating a bias magnetic field to prevent magnetic inversion of said magnetically switchable wire, said magnetic casing having heat-treated portions partially differentiated in magnetic properties by heat treatment in the longitudinal direction thereof, said magnetically switchable wire being manufactured by the in-gas melt spinning method.

24. A manufacturing method for a magnetic marker according to claim 23, wherein a cooling gas used in said in-gas melt spinning method contains helium and oxygen.

* * * * *